US011300906B2

(12) United States Patent
Takemasa et al.

(10) Patent No.: US 11,300,906 B2
(45) Date of Patent: Apr. 12, 2022

(54) FIXING DEVICE

(71) Applicant: Canon Kabushiki Kaisha, Tokyo (JP)

(72) Inventors: Rikiya Takemasa, Chiba (JP); Hidekazu Tatezawa, Saitama (JP); Yutaro Tsuno, Tokyo (JP); Kenichi Tanaka, Ibaraki (JP); Youichi Chikugo, Chiba (JP); Mitsuru Hasegawa, Ibaraki (JP); Hiroki Kawai, Chiba (JP); Suguru Takeuchi, Chiba (JP); Ayano Ogata, Ibaraki (JP); Yasuharu Toratani, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/123,773

(22) Filed: Dec. 16, 2020

(65) Prior Publication Data

US 2021/0191298 A1 Jun. 24, 2021

(30) Foreign Application Priority Data

Dec. 18, 2019 (JP) ..... JP2019-228643

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2017; G03G 15/2053; G03G 15/2064; G03G 2215/2003; G03G 2215/2038
See application file for complete search history.

(56) References Cited

U.S. PATENT DOCUMENTS

| | | | |
|---|---|---|---|
| 7,890,024 B2 | 2/2011 | Hirayama et al. | 399/122 |
| 7,890,038 B2 | 2/2011 | Chikugo et al. | 399/323 |
| 8,005,414 B2 | 8/2011 | Hasegawa | 399/331 |

(Continued)

FOREIGN PATENT DOCUMENTS

| | | |
|---|---|---|
| JP | 2014-228765 A | 12/2014 |
| JP | 2016-28264 A | 2/2016 |

OTHER PUBLICATIONS

U.S. Appl. No. 17/123,793, filed Dec. 16, 2020.

(Continued)

*Primary Examiner* — Thomas S Giampaolo, II
(74) *Attorney, Agent, or Firm* — Venable LLP

(57) ABSTRACT

A fixing device for fixing a toner image on a sheet includes a rotatable fixing belt; a heating roller wherein the belt is stretched and entrained around the heating roller to heat the belt; a pressing pad of resin material provided inside of the belt; a rotatable pressing member contacting an outer peripheral surface of the belt and pressing against the pad through the belt to form a nip configured to nip and feed the sheet; a supporting metal stay supporting the pad and including a planar bottom surface faced to the pad; and projected portions integrally molded with the pad and provided along a widthwise direction of the pad, the projected portions projecting and contacting to the bottom surface such that the pad is supported by the stay. A contact area between the projected portions and the bottom surface is not less than 5% and not more than 40% of the area of the bottom surface.

8 Claims, 10 Drawing Sheets

(56) References Cited

U.S. PATENT DOCUMENTS

| | | | | |
|---|---|---|---|---|
| 8,655,242 | B2 | 2/2014 | Tanaka | 399/323 |
| 8,712,272 | B2 | 4/2014 | Takeuchi et al. | 399/69 |
| 8,818,254 | B2 | 8/2014 | Arimoto et al. | 399/329 |
| 8,862,009 | B2 | 10/2014 | Takeuchi et al. | 399/69 |
| 8,909,114 | B2 | 12/2014 | Takeuchi | 399/329 |
| 8,917,999 | B2 | 12/2014 | Takada et al. | 399/43 |
| 8,918,003 | B2 | 12/2014 | Kawai et al. | 399/69 |
| 8,929,762 | B2 | 1/2015 | Shinagawa et al. | 399/69 |
| 8,942,612 | B2 | 1/2015 | Tanaka | 399/330 |
| 8,971,746 | B2 | 3/2015 | Hasegawa et al. | 399/67 |
| 8,983,325 | B2 | 3/2015 | Takeuchi | 399/69 |
| 8,989,640 | B2 | 3/2015 | Kitagawa et al. | 399/320 |
| 9,026,020 | B2 | 5/2015 | Chikugo | 399/322 |
| 9,057,993 | B2 | 6/2015 | Takeuchi et al. | G03G 15/206 |
| 9,069,299 | B2 | 6/2015 | Tanaka | G03G 15/2028 |
| 9,235,168 | B2 | 1/2016 | Kawai | G03G 15/2053 |
| 9,274,467 | B2 | 3/2016 | Takeuchi et al. | G03G 15/2053 |
| 9,329,557 | B2 | 5/2016 | Kitagawa et al. | G03G 15/20 |
| 9,348,292 | B2 | 5/2016 | Chikugo | G03G 15/6573 |
| 9,354,562 | B2 | 5/2016 | Tanaka | G03G 15/2028 |
| 9,367,006 | B2 | 6/2016 | Yoshida et al. | G03G 15/2053 |
| 9,389,554 | B2 | 7/2016 | Tanaka et al. | G03G 15/2021 |
| 9,392,642 | B2 | 7/2016 | Tanaka et al. | H05B 1/00 |
| 9,465,336 | B2 | 10/2016 | Saito et al. | G03G 15/2053 |
| 9,547,262 | B2 | 1/2017 | Hirayama et al. | G03G 15/2039 |
| 9,563,163 | B2 | 2/2017 | Tanaka et al. | G03G 15/502 |
| 9,977,385 | B2 | 5/2018 | Miura et al. | G03G 15/2053 |
| 10,061,242 | B2 | 8/2018 | Tanaka | G03G 15/2032 |
| 10,133,219 | B2 | 11/2018 | Kawai | G03G 15/55 |
| 10,241,433 | B2 | 3/2019 | Tanaka et al. | G03G 13/20 |
| 10,241,455 | B2 | 3/2019 | Fukamachi et al. | G03G 15/2039 |
| 10,437,185 | B2 | 10/2019 | Yamaguchi et al. | G03G 15/5004 |
| 10,564,576 | B2 | 2/2020 | Tanaka et al. | G03G 15/2053 |
| 10,627,751 | B2 | 4/2020 | Hasegawa et al. | G03G 15/2021 |
| 10,719,042 | B2 | 7/2020 | Hirayama et al. | G03G 15/2039 |
| 10,802,430 | B2 | 10/2020 | Toratani et al. | G03G 15/2053 |
| 2013/0142532 | A1 | 6/2013 | Kitagawa et al. | 399/67 |
| 2013/0195524 | A1* | 8/2013 | Ishii | G03G 15/206 399/329 |
| 2014/0348558 | A1 | 11/2014 | Inoue et al. | |
| 2016/0011549 | A1 | 1/2016 | Utsunomiya et al. | |
| 2017/0153581 | A1 | 6/2017 | Chikugo | G03G 15/20 |
| 2017/0192387 | A1 | 7/2017 | Tanaka | G03G 15/2039 |
| 2020/0041940 | A1 | 2/2020 | Kawai et al. | G03G 15/2017 |
| 2020/0133174 | A1 | 4/2020 | Kawai et al. | G03G 2215/2038 |
| 2020/0159153 | A1 | 5/2020 | Takemasa | G03G 15/2053 |
| 2020/0233353 | A1 | 7/2020 | Tsuno et al. | G03G 15/2053 |
| 2020/0233354 | A1 | 7/2020 | Tatezawa et al. | G03G 15/2064 |
| 2020/0310309 | A1 | 10/2020 | Kawai et al. | G03G 15/2039 |
| 2021/0072699 | A1 | 3/2021 | Inoue et al. | G03G 15/2017 |

OTHER PUBLICATIONS

U.S. Appl. No. 17/094,077, filed Nov. 10, 2020.
U.S. Appl. No. 17/160,062, filed Jan. 27, 2021.
U.S. Appl. No. 17/160,071, filed Jan. 27, 2021.

* cited by examiner

FIXING DEVICE

FIELD OF THE INVENTION AND RELATED ART

The present invention relates to a fixing device for fixing a toner image, carried on a recording material, on the recording material.

As the fixing device, a constitution in which a nip in which the recording material is nipped and fed between a fixing belt which is an endless belt and a pressing roller contacting an outer peripheral surface of the fixing belt and in which the toner image is fixed on the recording material passing through the nip has been known (Japanese Laid-Open Patent Application (JP-A) 2014-228765). In the case of the constitution disclosed in JP-A 2014-228765, a pad member for forming the above-described nip is provided inside the fixing belt so as to oppose the pressing roller. The pad member is supported by a supporting member made of metal or the like.

As in the constitution in JP-A 2014-228765, in the case where the pad member is supported by the supporting member made of metal, much heat is transformed from the fixing belt heated by a heater to the supporting member through the pad member. When an amount of the transferred heat is large, a turning on time of the heater becomes long, so that electric power consumption becomes large. For this reason, there is a constitution in which the heat transfer from the pad member to the supporting member is suppressed by decreasing a contact area between the pad member and the supporting member.

For example, a supporting structure in which a stay is provided with projections and thus the contact area between the supporting member (metal stay) and the pad member is reduced is disclosed in JP-A 2016-28264.

Specifically, in JP-A 2016-28264, a constitution in which the projections are provided by penetration through a supporting plate as one of a plurality of metal plates is employed. Thus, in the constitution in which the metal supporting plate is provided with the projections, a problem such that the number of component parts increases and a structure becomes complicated arises.

SUMMARY OF THE INVENTION

A principal object of the present invention is to provide a fixing device capable of decreasing a contact area between a pad member and a supporting member with a small number of component parts in a constitution in which the pad member made of a resin material and a stay mad of metal are provided opposed to each other.

According to an aspect of the present invention, there is provided a fixing device for fixing a toner image on a recording material, the fixing device comprising a rotatable fixing belt; a heating roller including a heater wherein the belt is stretched and entrained around the heating roller to heat the belt; a pressing pad of resin material provided inside of the belt; a rotatable pressing member contacting an outer peripheral surface of the belt and pressing against the pressing pad through the belt to form a nip configured to nip and feed the recording material; a supporting metal stay supporting the pressing pad and including a planar bottom surface faced to the pressing pad; and a plurality of projected portions integrally molded with the pressing pad and provided along a widthwise direction of the pressing pad, the projected portions projecting and contacting to the bottom surface such that the pressing pad is supported by the supporting stay, wherein a contact area between the projected portions and the bottom surface is not less than 5% and not more than 40% of the area of the bottom surface.

Further features of the present invention will become apparent from the following description of exemplary embodiments with reference to the attached drawings.

Figure 4:
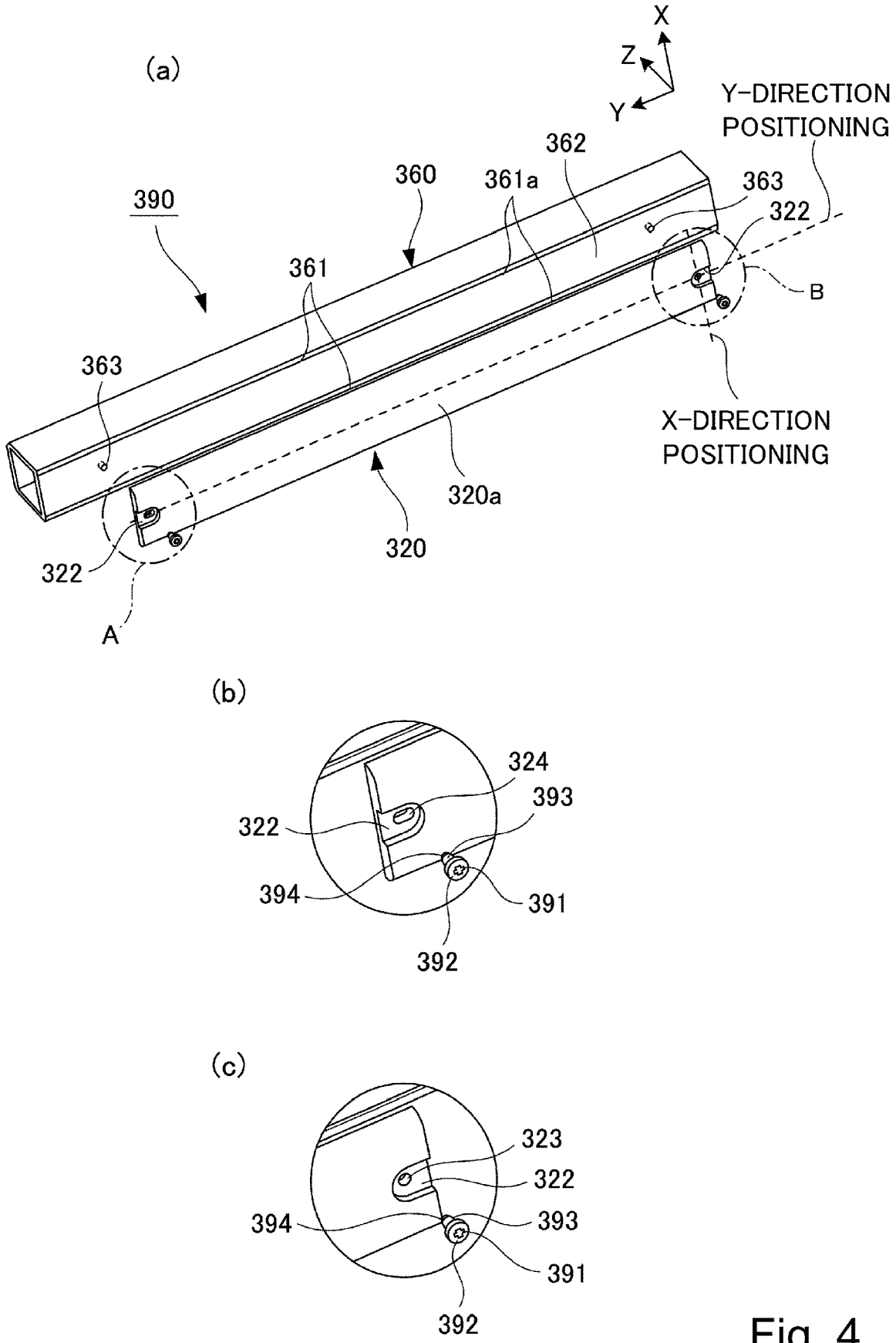

Part (a) of FIG. 4 is an exploded perspective view of a fixing pad unit in the first embodiment, part (b) of FIG. 4 is an enlarged view of a portion A of part (a) of FIG. 4, and part (c) of FIG. 4 is an enlarged view of a portion B of part (a) of FIG. 4.

Figure 5:
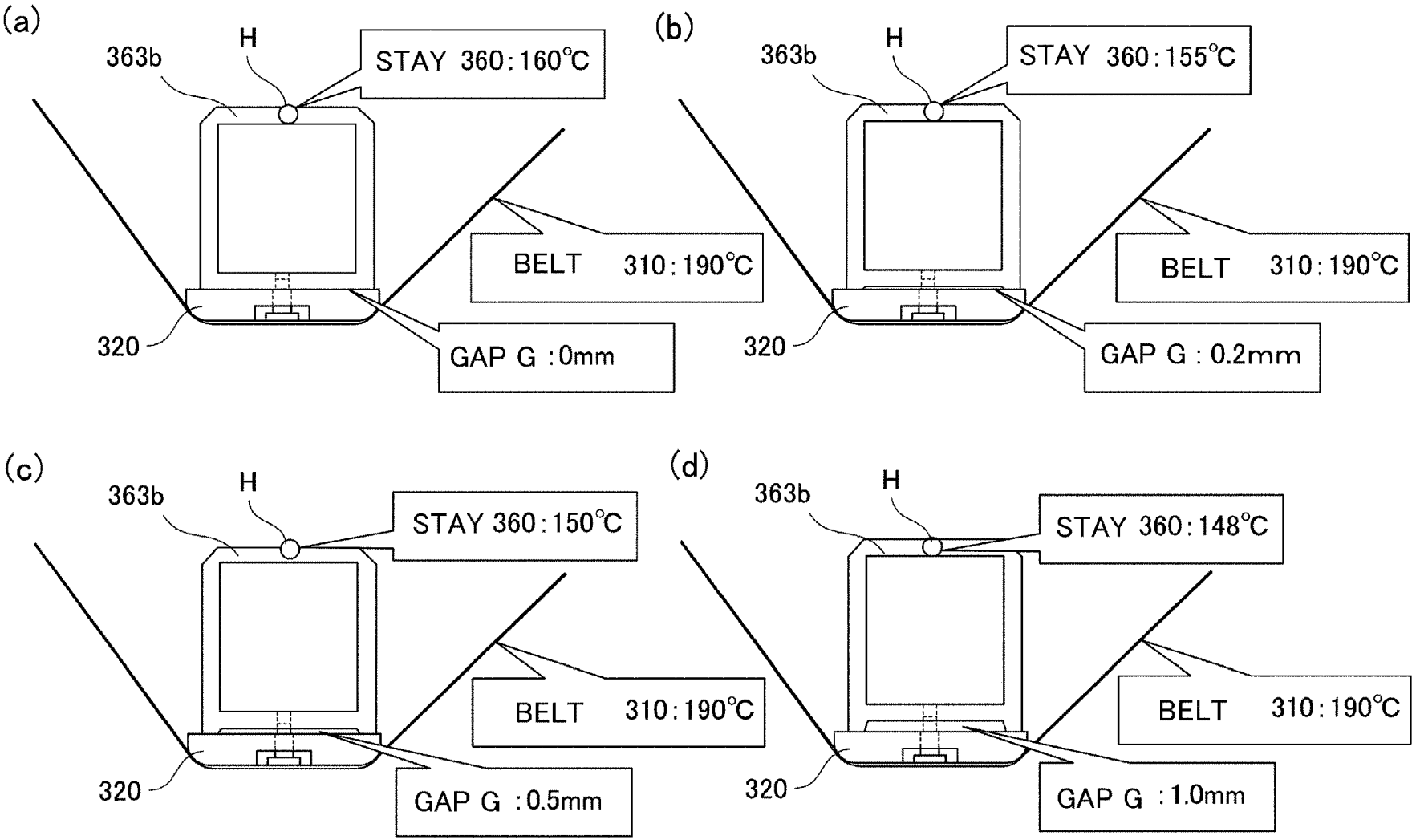

Parts (a) to (d) of FIG. 5 are sectional views of the fixing pad unit and a periphery thereof in the first embodiment, in which part (a) shows a state of a gap of 0 mm, part (b) shows a state of a gap of 0.2 mm, part (c) shows a state of a gap of 0.5 mm, and part (d) shows a state of a gap of 1.0 mm.

Figure 6:
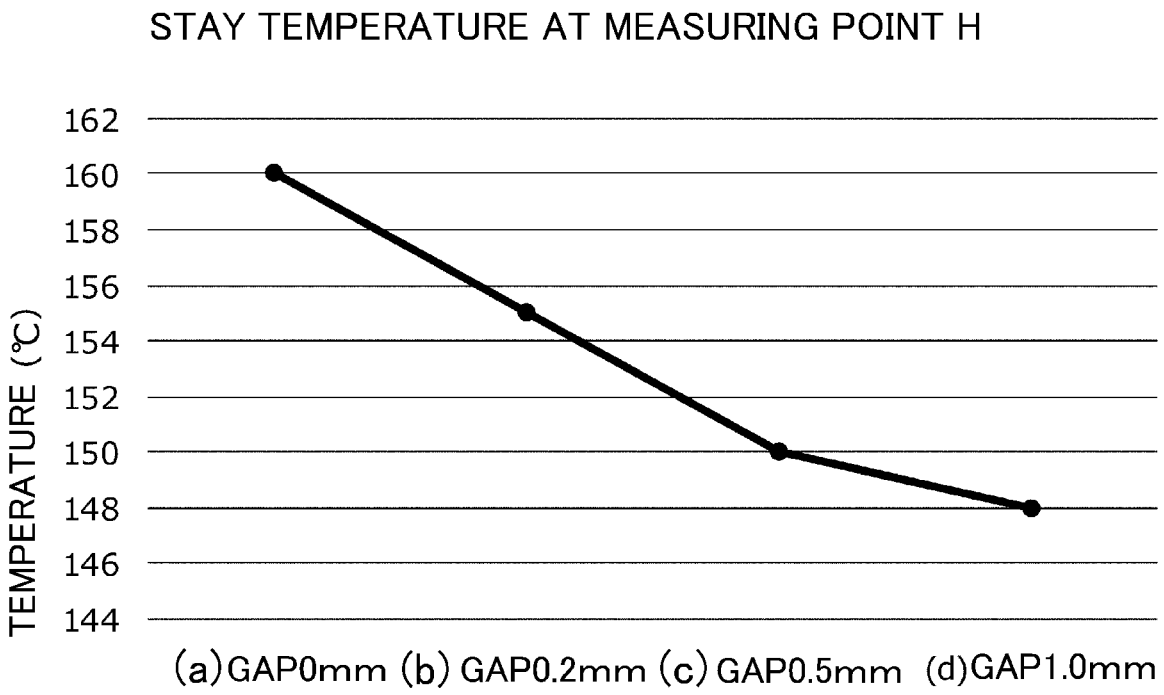

FIG. 6 is a graph showing a relationship between the gap and a temperature of a stay.

Figure 7:
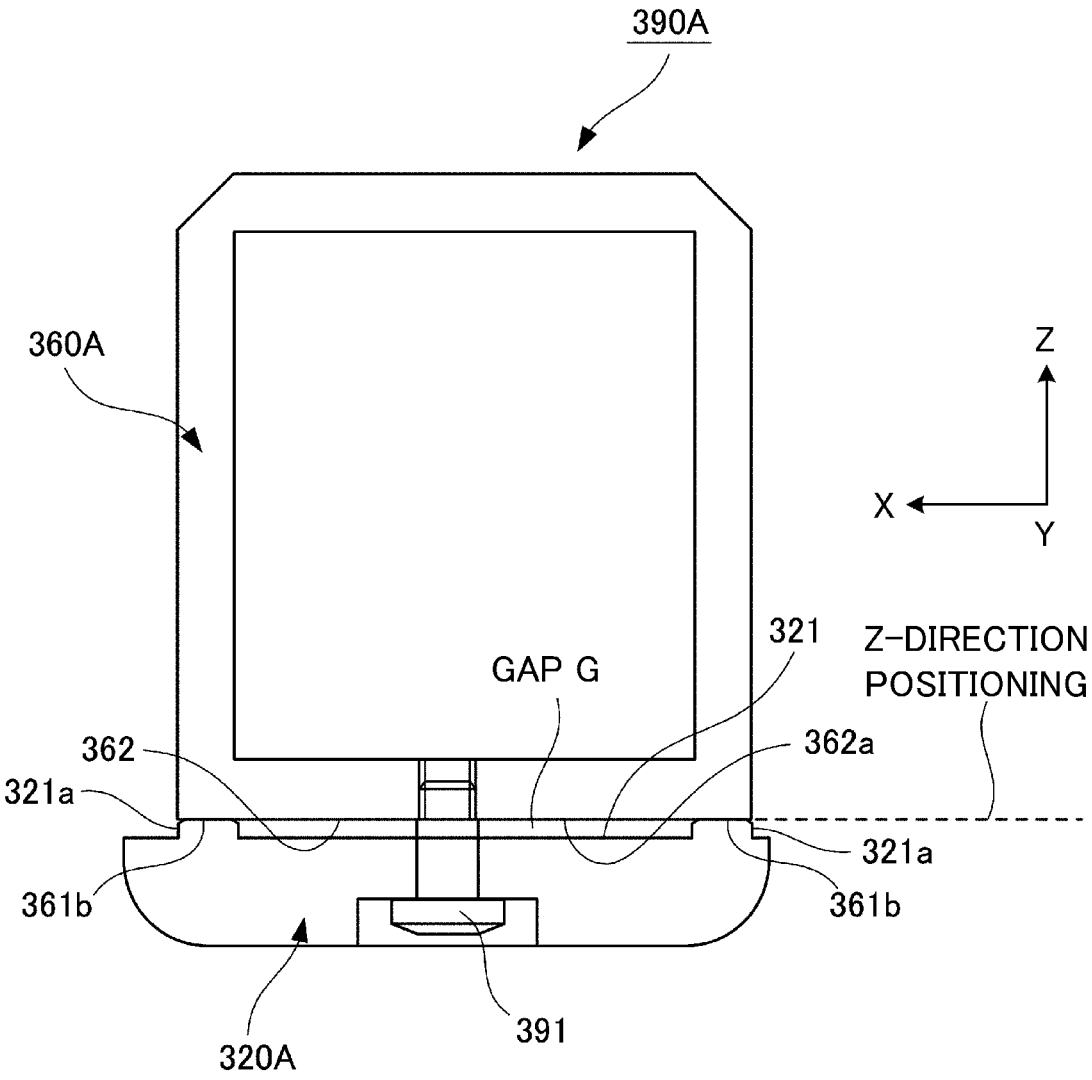

FIG. 7 is a sectional view of a fixing pad unit in a second embodiment.

Figure 8:
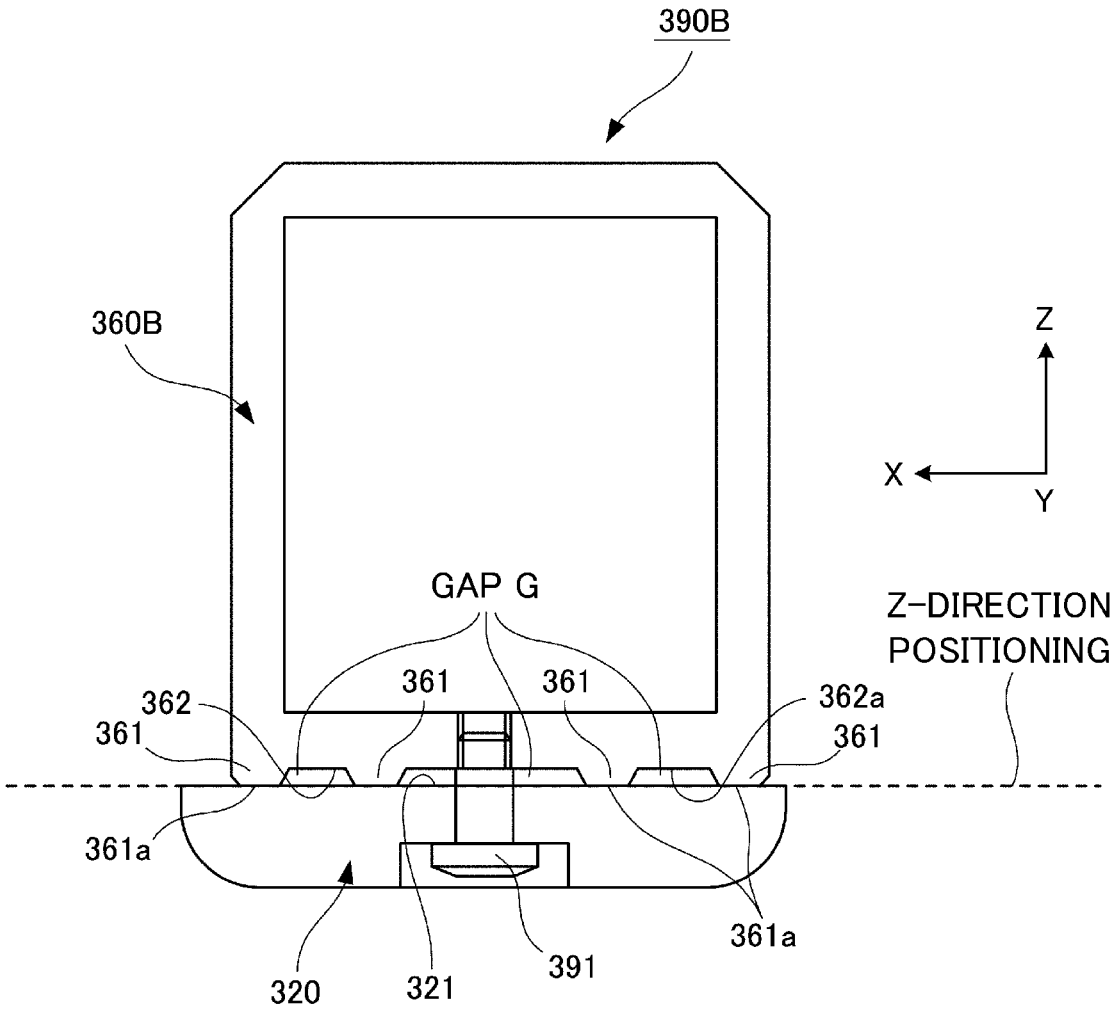

FIG. 8 is a sectional view of a fixing pad unit in a third embodiment.

Figure 9:
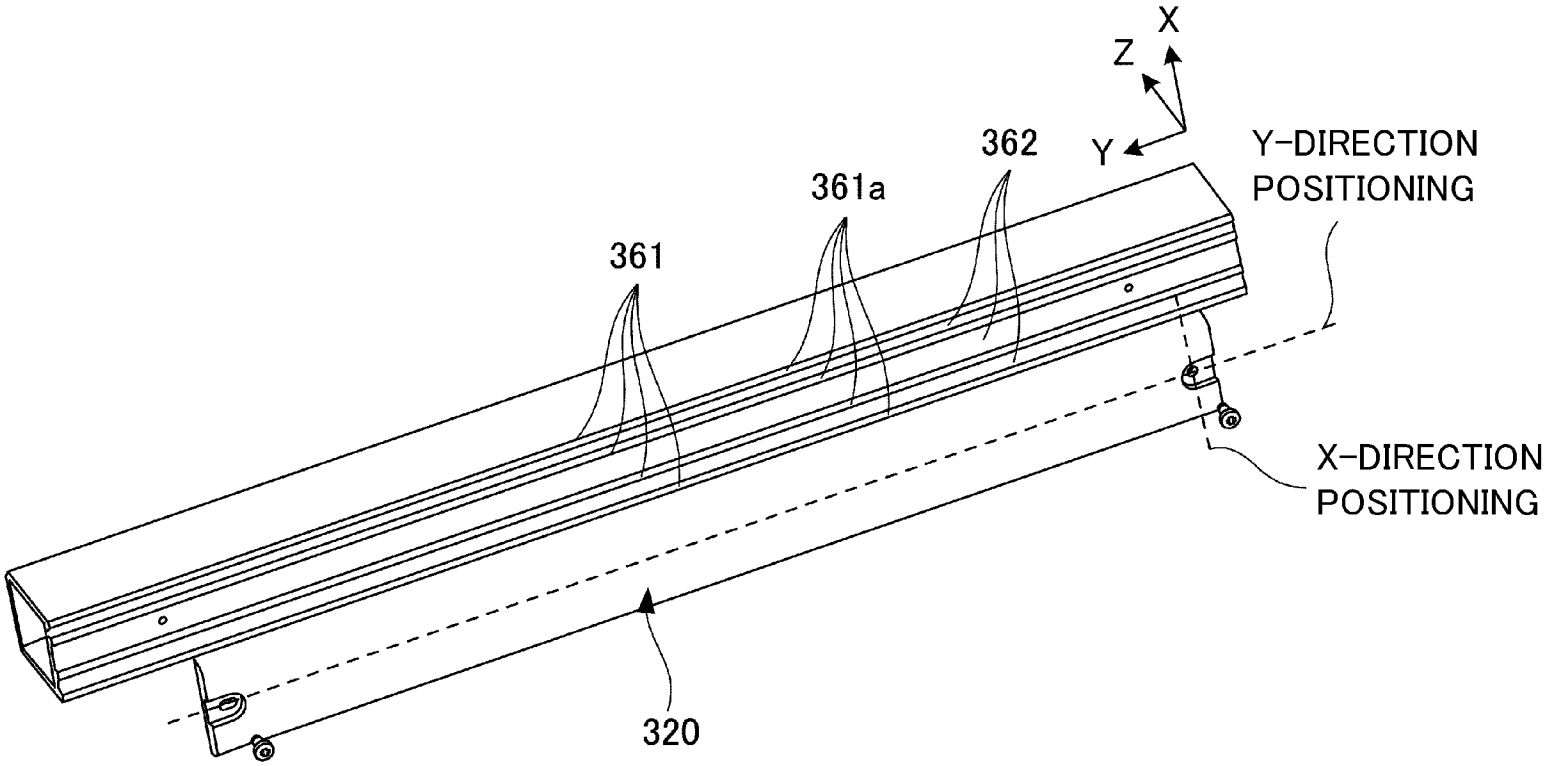

FIG. 9 is an exploded perspective view of the fixing pad unit in the third embodiment.

Figure 10:
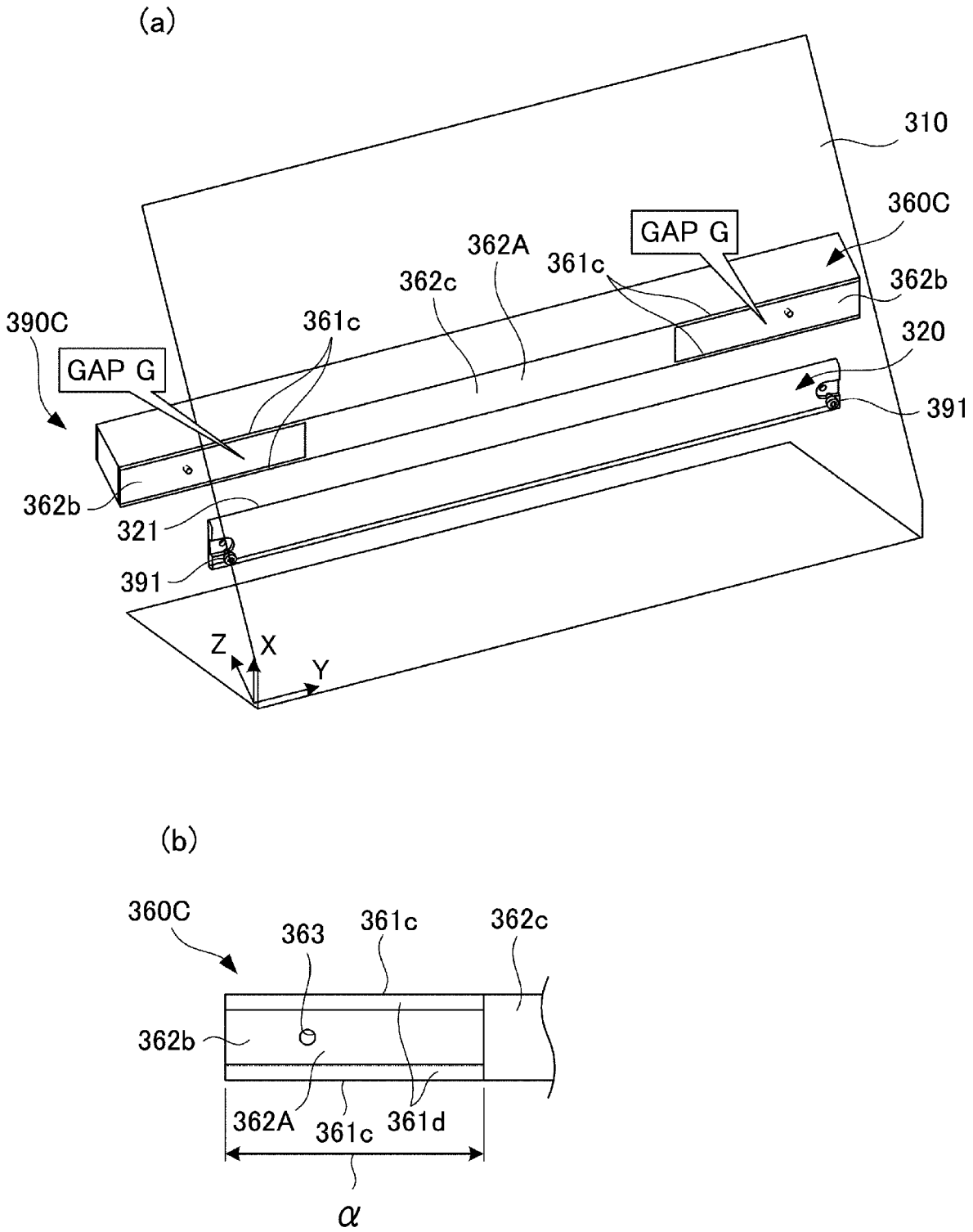

Part (a) of FIG. 10 is an exploded perspective view of a fixing pad unit in a fourth embodiment, and part (b) of FIG. 10 is a plan view of an end portion side of a stay as seen from a bottom side in the fourth embodiment.

DESCRIPTION OF THE EMBODIMENTS

First Embodiment

A first embodiment of the present invention will be described using FIGS. 1 to 6. First, a general structure of the image forming apparatus according to this embodiment will be described using FIG. 1.

[Image Forming Apparatus]

An image forming apparatus 1 is an electrophotographic full-color printer including four image forming portions Pa, Pb, Pc and Pd provided correspondingly to four colors of yellow, magenta, cyan and black. In this embodiment, the image forming apparatus 1 is of a tandem type in which the image forming portions Pa, Pb, Pc and Pd are disposed along a rotational direction of an intermediary transfer belt 204 described later. In this embodiment, the image forming apparatus 1 forms, on a recording material, a toner image (image) depending on an image signal from a host device, such as a personal computer, communicatably connected to an image forming apparatus main assembly 3 or an image reading portion (original reading device) 2 connected to the image forming apparatus main assembly 3. As the recording material, it is possible to cite a sheet material such as a sheet, a plastic film or a cloth.

The image forming apparatus 1 includes the image reading portion 2 and the image forming apparatus main assembly 3. The image reading portion reads an original placed on an original supporting platen glass 21, and light emitted from a light source 22 is reflected by the original and is formed in an image on a CCD sensor 24 through an optical system member 23 such as a lens. Such an optical system unit converts the original into an electric signal data stream (string) for each of lines by scanning the original with the light in an arrow direction. An image signal obtained by the CCD sensor 24 is sent to the image forming apparatus main assembly 3, and then subjected to image processing for an associated one of the image forming portions by a controller 30 as described later. Further, the controller 30 also receives external input as the image signal from an external host device such as a print server.

The image forming apparatus main assembly 3 include a plurality of image forming portions Pa, Pb, Pc and Pd, and in each of the image forming portions, image formation is carried out on the basis of the above-described image signal. That is, the image signal is converted into a laser beam subjected to PWM (pulse width modulation) control by the controller 30. A polygon scanner 31 as an exposure device scans each of photosensitive drum surfaces with the laser beam. Thus, photosensitive drums 200*a* to 200*d* as image bearing members of the respective image forming portions Pa to Pd are irradiated with the laser beams.

Incidentally Pa is the image forming portion for yellow (Y), Pb is the image forming portion for magenta (M), Pc is the image forming portion for cyan (C) and Pd is the image forming portion for black (Bk), and these portions form images of associated colors. The image forming portions Pa to Pd have the substantially same structure, and therefore, in the following, the image forming portion Pa for Y is described in detail and other image forming portions will be omitted from description. In the image forming portion Pa, on the surface of the photosensitive drum 200*a*, a toner image is formed on the basis of the image signal as described below.

A charging roller 201*a* as a primary charger electrically charges the surface of the photosensitive drum 200*a* to a predetermined potential to prepare for electrostatic latent image formation. An electrostatic latent image is formed on the surface of the photosensitive drum 200*a* charged to the predetermined potential, by irradiation with the laser beam from the polygon scanner 31. A developing device 202*a* develops the electrostatic latent image on the photosensitive drum 200*a*, so that the toner image is formed. A primary transfer roller 203*a* transfers the toner image from the photosensitive drum 200*a* onto the intermediary transfer belt 204 under application of a primary transfer bias of an opposite polarity to a charge polarity of toner by electrically discharging the intermediary transfer belt 204 from a back surface (side). The surface of the photosensitive drum 200*a* after the transfer is cleaned by a cleaner 207*a*.

Further, the toner image on the intermediary transfer belt 204 is fed to a subsequent image forming portion, so that in the order of Y, M, C and Bk, the respective color toner images successively formed in the associated image forming portions are transferred, and thus the four color toner images are formed on the surface of the intermediary transfer belt 204. Then, the toner images passed through the image forming portion Pd for Bk positioned on a most downstream side with respect to a rotational direction of the intermediary transfer belt 204 are fed to a secondary transfer portion constituted by a secondary transfer roller pair 205 and 206. Then, in the secondary transfer portion, the toner images are secondary-transferred from the intermediary transfer belt 204 onto the recording material under application of a secondary transfer electric field of an opposite polarity to the charge polarity of the toner images.

The recording material is accommodated in a cassette 9, and the recording material fed from the cassette 9 is fed to a registration portion 208 constituted by, for example, a pair of registration rollers and awaits at the registration portion 208. Thereafter, the registration portion 208 is subjected to timing control for aligning the toner images on the intermediary transfer belt 204 with the sheet (recording material), and then the recording material is fed to the secondary transfer portion.

The recording material on which the toner images are transferred at the secondary transfer portion is fed to a fixing device 8, in which the toner images are heated and pressed, so that the toner images carried on the recording material are fixed on the recording material. The recording material passed through the fixing device 8 is discharged onto a discharge tray 7. Incidentally, in the case where images are formed on double surfaces (sides) of the recording material, when transfer and fixation of the toner image onto a first surface (front surface) of the recording material are ended, the recording material is turned upside down by being fed through a reverse feeding portion 10, and transfer and fixation of the toner image onto a second surface (back surface) of the recording material are carried out, so that the recording material is stacked on the discharge tray 7.

Incidentally, the controller 30 carries out control of entirety of the image forming apparatus 1 as described above. Further, the controller 30 is capable of making various settings on the basis of input from an operating portion 4 of the image forming apparatus 1. Such a controller 30 includes a CPU (Central Processing Unit), a ROM (Read Only Memory) and a RAM (Random Access Memory). The CPU carries out control of respective portions while reading programs which are stored in the ROM and which correspond to control procedures. Further, in the RAM, operation data and input data are stored, and the CPU carries out the control by making reference to the data stored in the RAM, on the basis of the above-described programs or the like.

[Fixing Device]

Figure 1:
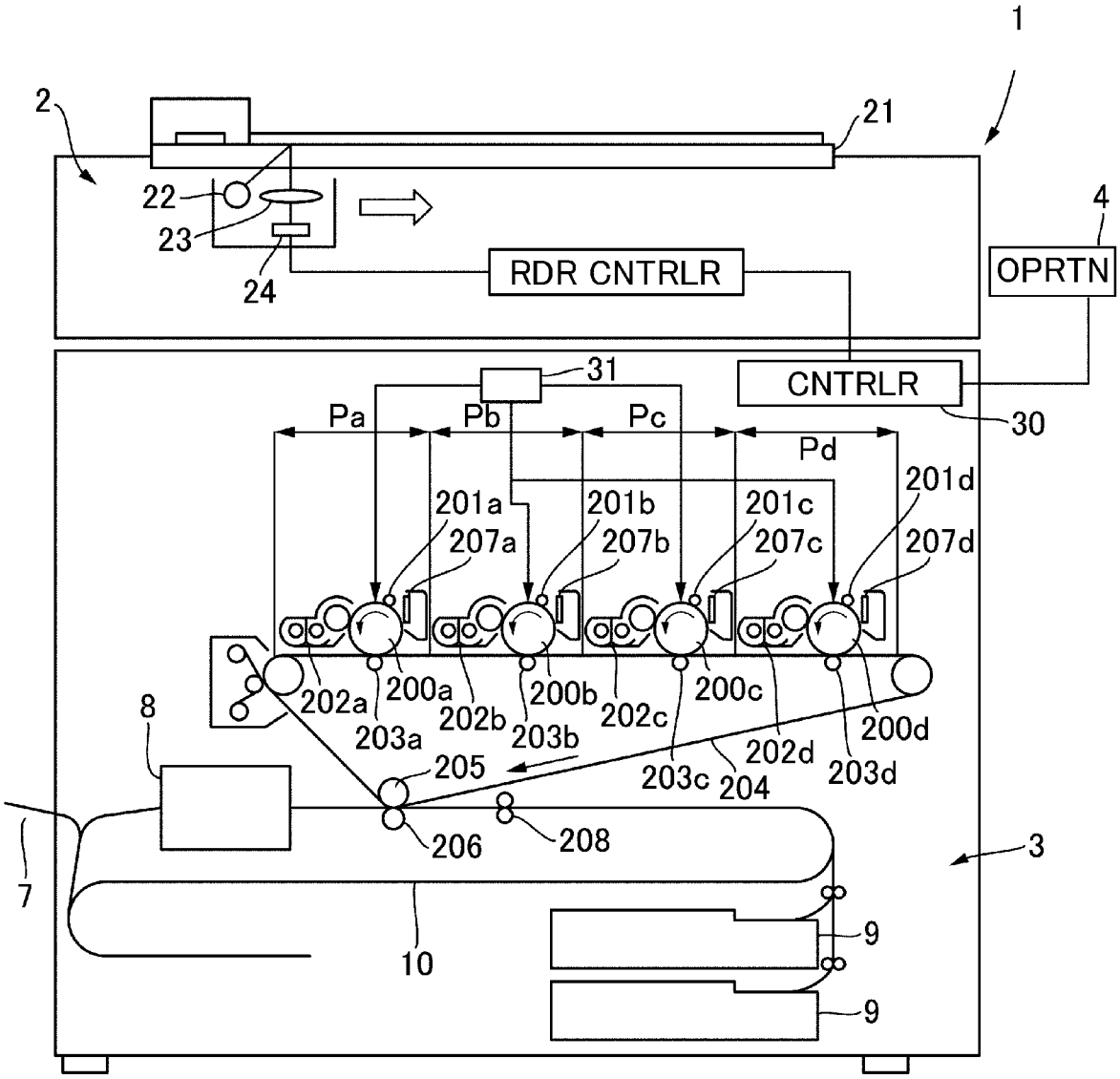
FIG. 1 is a schematic sectional view of an image forming apparatus in a first embodiment.
Figure 2:
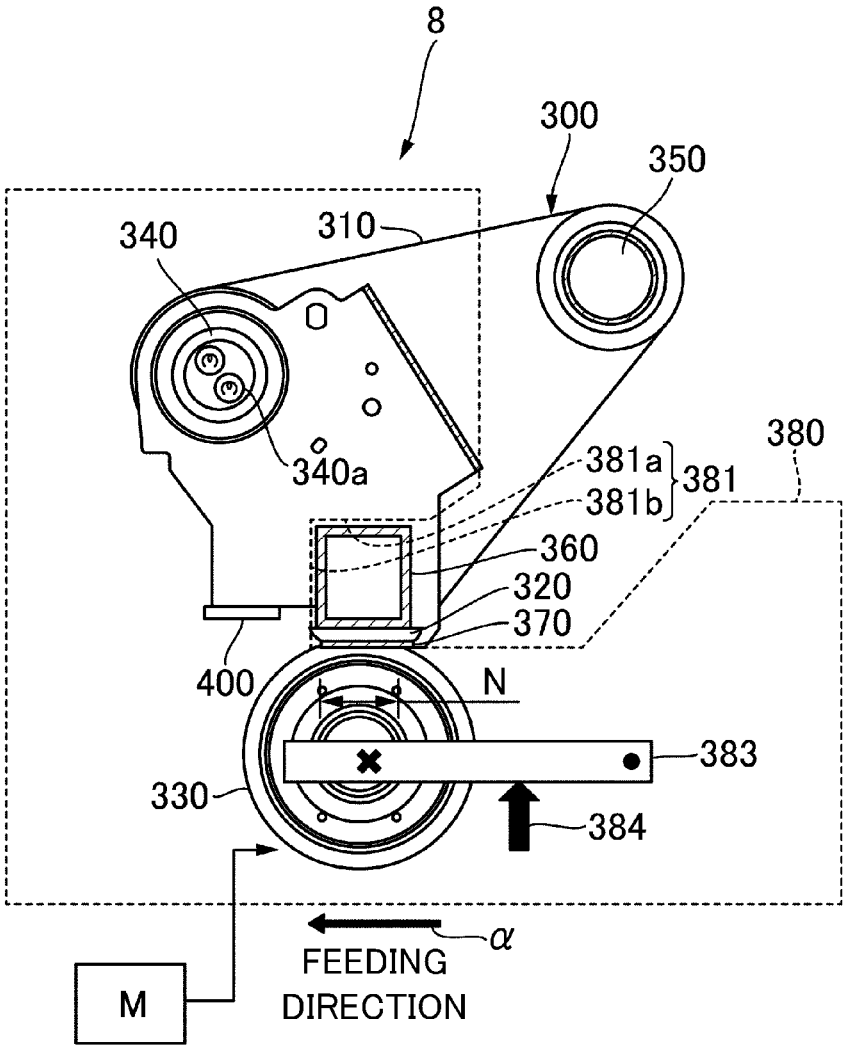
FIG. 2 is a schematic sectional view of a fixing device according to the first embodiment.

Next, a structure of the fixing device 8 in this embodiment will be described using FIG. 2. In this embodiment, a fixing device of a belt heating type using an endless belt is employed. In FIG. 2, the recording material is fed from a right to left direction as shown by an arrow a. The fixing device 8 includes a heating unit 300 including a fixing belt as an endless and rotatable belt and a pressing roller 330 as a contact member, contacting the fixing belt 310, for forming a nip in cooperation with the fixing belt 310.

The heating unit 300 includes the above-described fixing belt 310, a fixing pad 320 as a pad member, a heating roller 340 as a stretching roller, and a steering roller 350. The pressing roller 330 rotates in contact with an outer peripheral surface of the fixing belt 310 and is also rotatable driving member for imparting a driving force to the fixing belt 310.

The fixing belt 310 which is an endless belt has a heat conductive property, a heat resistant property and the like, and has a thin cylindrical shape with an inner diameter of 120 mm, for example. In this embodiment, the fixing belt 310 has a three-layers structure consisting of a base layer, an elastic layer formed on an outer peripheral surface of the base layer, and a parting layer formed on an outer peripheral surface of the elastic layer. The base layer is 60 μm in thickness and a polyimide (PI) resin material is used. The elastic layer is 30 μm in thickness and a silicone rubber material is used. The parting layer is 300 μm in thickness and PFA (polytetrafluoroethylene-perfluoroalkoxyethylene copolymer) resin material is used. Such a fixing belt 310 is stretched by the fixing pad 320, the heating roller 340 and the steering roller 350.

The fixing pad 320 is not only disposed inside the fixing belt 310 so as to oppose the pressing roller 330 through the fixing belt 310, but also forms a nip N in which the recording material is nipped and fed between the fixing belt 310 and the pressing roller 330. In this embodiment, the fixing pad 320 is a substantially plate-like member long along a widthwise direction (a longitudinal direction crossing the rotational direction of the fixing belt 310, rotational axis direction of the heating roller 340) of the fixing belt 310. The fixing pad 320 is pressed against the fixing belt 310 toward the pressing roller 330, so that the nip N is formed. As a material of the fixing pad 320, an LCP (liquid crystal polymer) is used.

The fixing pad 320 is formed in a flat surface shape at least in a part of a portion thereof for forming the nip. That is, a portion thereof contacting a lubrication sheet 370 described later toward an inner peripheral surface of the fixing belt 310 is formed in a substantially flat surface shape, so that a shape of the nip becomes a substantially flat shape. By employing such a constitution, particularly in the case where the toner image is fixed on an envelope as the recording material, it is possible to suppress that a crease or an image deviation occurs on the envelope.

The fixing pad 320 is supported by a stay 360, as a supporting member made of metal, provided inside the fixing belt 310. That is, the stay 360 is disposed on a side opposite from the pressing roller 330 with respect to the fixing pad 320 and supports the fixing pad 320. Such a stay 360 is a reinforcing member which is long along the longitudinal direction of the fixing belt 310 and which has rigidity. The stay 360 contacts the fixing pad 320 and supports the fixing pad 320. That is, the stay 360 imparts strength to the fixing pad 320 and ensures a pressing force in the nip N when the fixing pad 320 is pressed by the pressing roller 330.

The stay 360 is made of metal such as a stainless steel, and a cross-section thereof perpendicular to the longitudinal direction of the stay 360 which crosses the rotational direction of the fixing belt 310 has a substantially rectangular shape. For example, the stay 360 is formed with a 3 mm-thick drawing material of SUS 304 (stainless steel), and the cross-section thereof is formed in a substantially square-shaped hallow portion, so that strength is ensured. Incidentally, the stay 360 may also formed in a substantially rectangular shape in cross-section by combining a plurality of metal plates and then by fixing the plates to each other through welding or the like. Further, the material of the stay 360 is not limited to the stainless steel when strength required is ensured.

Between the fixing pad 320 and the fixing belt 310, a lubrication sheet 370 is interposed. In this embodiment, as the lubrication sheet 370, a PI (polyimide) sheet coated with PTFE (polytetrafluoroethylene) is used, and a thickness thereof is 100 μm. The PI sheet is provided with projections of 100 μm formed with an interval of 1 mm, so that a contact area with the fixing belt 310 is reduced and thus a sliding resistance is decreased.

Further, onto an inner peripheral surface of the fixing belt 310, a lubricant is applied, so that the fixing belt 310 smoothly slides on the lubrication sheet 370 covering the fixing pad 320. As the lubricant, silicone oil of 100 cSt in viscosity is used.

As shown in FIG. 2, the heating roller 340 is disposed inside the fixing belt 310 and stretches the fixing belt 310 in cooperation with the fixing pad 320, and imparts a driving force to the fixing belt 310. The heating roller 340 is formed of metal such as aluminum or stainless steel in a cylindrical shape, and in which a halogen heater **340*a* as a heating source for heating the fixing belt 310 is provided. Further, the heating roller 340 is heated up to a predetermined temperature by the halogen heater 340*a***.

In this embodiment, from a viewpoint of thermal conductivity, the heating roller 340 is formed with, for example, an aluminum pipe of 40 mm in outer diameter and 1 mm in thickness, and a surface layer thereof is subjected to anodization (alumite) treatment. Further, the halogen heater **340*a* may also be a single heater, but when temperature distribution of the heating roller 340 with respect to a longitudinal direction (rotational axis direction) is taken into consideration, a plurality of halogen heaters 340*a* may desirably be used. The halogen heaters 340*a* provided in plurality have light distribution different from each other with respect to the longitudinal direction, and a lighting ratio is controlled depending on a size of the recording material. In this embodiment, two halogen heaters 340*a* are disposed. Incidentally, the heating source is not limited to the halogen heater, but may also be another heater, such as a carbon heater, capable of heating the heating roller 340**.

The fixing belt 310 is heated by the heating roller 340 heated by the halogen heater **340*a*** and is controlled at a predetermined target temperature depending on a kind of the recording material, on the basis of temperature detection by an unshown thermistor.

The steering roller 350 is disposed inside the fixing belt 310 and stretches the fixing belt 310 in cooperation with the fixing pad 320 and the heating roller 340, and is rotated by the fixing belt 310. The steering roller 350 is tilted relative to a rotational axis direction (longitudinal direction) of the heating roller 340, and thus controls a position (shift position) of the fixing belt 310 with respect to this rotational axis direction. That is, the steering roller 350 includes a rotation center in the center of the steering roller 350 with respect to the rotational axis direction (longitudinal direction) and swings about this rotation center, so that the steering roller 350 tilts with respect to the longitudinal direction of the heating roller 340. By this, a difference in tension is generated between one side and the other side of the fixing belt 310 with respect to the longitudinal direction, so that the fixing belt 310 is moved in the longitudinal direction.

The fixing belt 310 shifts to either one of opposite end portions thereof during rotation due to outer diameter accuracy of the roller for stretching the fixing belt 310 and alignment accuracy between the respective rollers. For this reason, the shift of the fixing belt 310 is controlled by the steering roller 350. Incidentally, the steering roller 350 may also be swung by a driving source such as a motor, or a constitution in which the fixing belt 310 is swung by self-alignment may also be employed. Further, the rotation center may be the center of the steering roller 350 with respect to the longitudinal direction as in this embodiment and may also be an end portion of the steering roller 350 with respect to the longitudinal direction.

Further, in the case of this embodiment, the steering roller 350 is also tension roller which is urged by a spring supported by a frame of the heating unit 300 and which imparts predetermined tension to the fixing belt 310.

Further, the steering roller 350 is formed in a cylindrical shape by metal such as aluminum or stainless steel. In this embodiment, the steering roller 350 is a pipe which is 40 mm in outer diameter and 1 mm in thickness and which is made of stainless steel or aluminum, and opposite end portions thereof are rotation-supported by unshown bearings.

The pressing roller 330 as a rotatable driving member rotates in contact with the outer peripheral surface of the fixing belt 310 and imparts a driving force to the fixing belt 310. In this embodiment, the pressing roller 330 is a roller prepared by forming an elastic layer on an outer peripheral surface of a shaft and then by forming a parting layer on an outer peripheral surface of the elastic layer. The shaft is formed of stainless steel. The elastic layer is formed in a thickness of 5 mm with an electroconductive silicone rubber. The parting layer is formed in a thickness of 50 μm with PFA (tetrafluoroethylene-perfluoroalkoxyethylene copolymer) as a fluorine-containing resin material. The pressing roller 330 is supported by a fixing frame 380 of the fixing device 8 so as to be rotatable, and to one end portion thereof, a gear is fixed. The pressing roller 330 is connected to a motor M as a pressing roller driving source and is rotationally driven.

The fixing frame 380 is provided with a heating unit positioning portion 381, a pressing frame 383 and a pressing spring 384 as an urging means. The heating unit 300 is positioned to the fixing frame 380 by inserting the stay 360 into the heating unit positioning portion 381 and then by fixing the stay 360 to the heating unit positioning portion 381 with unshown fixing means. Here, the heating unit positioning portion 381 includes a pressing direction restricting surface 381*a* opposing the pressing roller 330 and includes a feeding direction restricting surface 381*b* which is an abutting surface with respect to an inserting direction of the heating unit 300. The stay 360 is fixed in a state in which movement thereof is restricted by the pressing direction restricting surface 381*a* and the feeding direction restricting surface 381*b*. At this time, the pressing roller 330 is spaced from the fixing belt 310.

The pressing roller 330 is contacted to the fixing belt 310 by moving the pressing frame 383 by an unshown driving source and a cam after the heating unit 300 is positioned to the heating unit positioning portion 381. Then, the pressing roller 330 is pressed against the fixing belt 310 toward the fixing pad 320. That is, in this embodiment, the pressing roller 330 is also a pressing member pressed toward the fixing belt 310. In this embodiment, a pressing force (pressure) during image formation is 1000 N, for example.

Further, in the case of this embodiment, a separating member 400 for separating the recording material from the fixing belt 310 is provided on a side downstream of the nip N with respect to the recording material feeding direction. The separating member 400 is disposed with a gap from the outer peripheral surface of the fixing belt 310 and separates the recording material, passed through the fixing nip N, from the fixing belt 310. Specifically, the separating member 400 is disposed close to a portion of the outer peripheral surface of the fixing belt 310 stretched between the fixing pad 320 and the heating roller 340. Further, the separating member 400 is formed in a blade shape, and a free end thereof is opposed to the outer peripheral surface of the fixing belt 310. Further, the separating member 400 is formed with a metal plate onto which a tape of a fluorine-containing resin material is applied for preventing toner deposition and image scars, and the like on the recording material due to sliding therebetween.

The thus-constituted fixing device 8 heats the toner image while nipping and feeding the toner image-carrying recording material in the nip N formed between the fixing belt 310 and the pressing roller 330. By this, the toner image is melted and is fixed on the recording material. In the case of this embodiment, during image formation, a peripheral speed of the fixing belt 310 is 300 mm/s, a pressing force in the nip N is 1000 N, and a temperature of the fixing belt is 180° C.

[Fixing Pad Unit]

Figure 3:
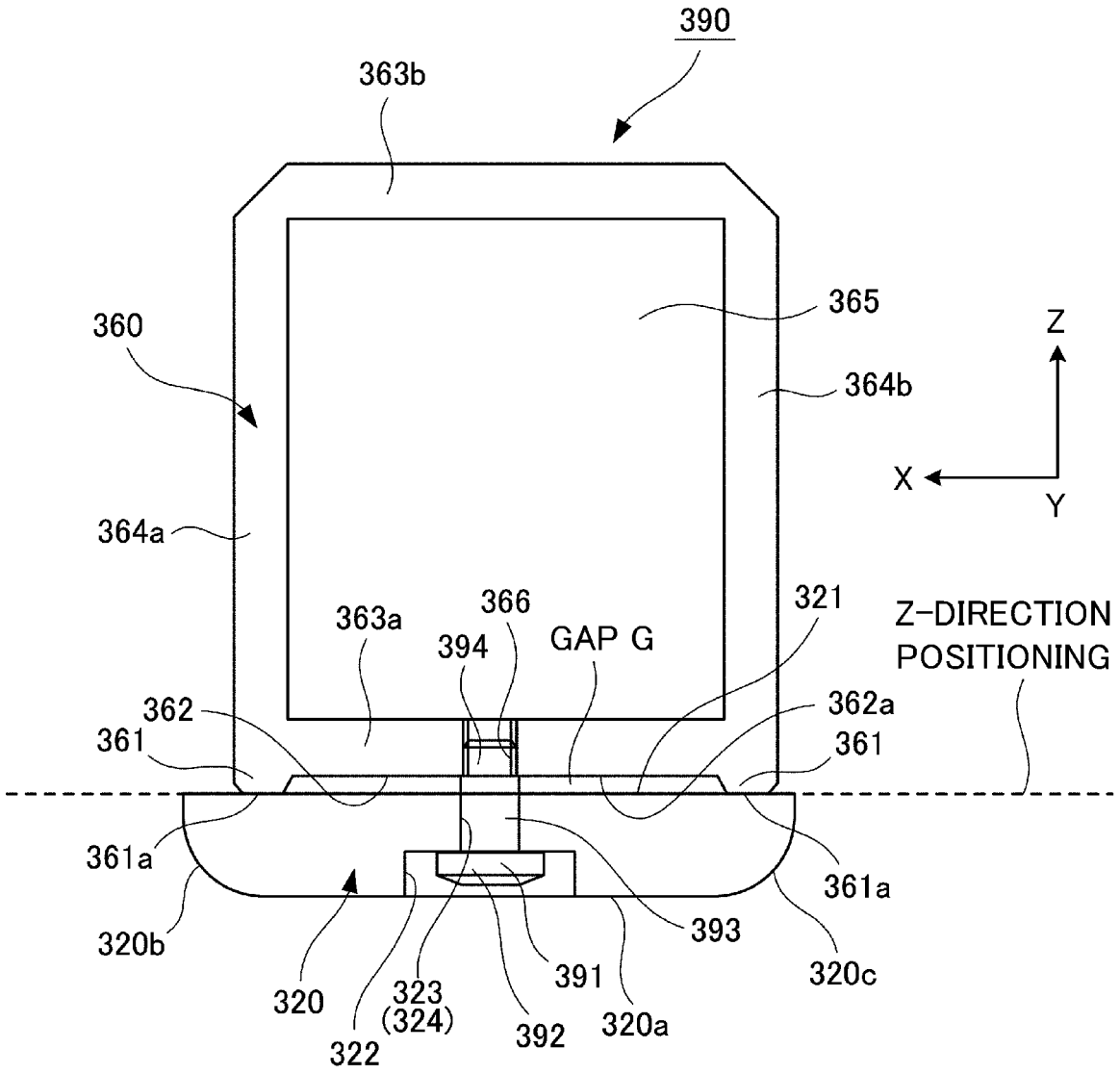
FIG. 3 is a sectional view of a fixing pad unit in the first embodiment.

Next, a fixing pad unit 390 including the fixing pad 320 and the stay 360 will be described using FIG. 3 and parts (a) to (c) of FIG. 4. FIG. 3 is a sectional view of the fixing pad unit 390 cut along a direction perpendicular to the longitudinal direction in the neighborhood of an end portion of the fixing pad unit 390, and part (a) of FIG. 4 is an exploded perspective view of the fixing pad unit 390 as seen from the fixing pad 320 side. The fixing pad unit 390 is constituted by fixing the fixing pad 320 and the stay 360 with stepped screws 391.

The fixing pad 320 includes a surface on a side where the nip N is formed, i.e., a surface opposing the pressing roller 330 through the fixing belt 310, which surface is constituted by a flat surface 320*a* and curved surfaces 320*b* and 320*c*. The curved surfaces 320*b* and 320*c* are provided so as to be continuous to opposite sides of the flat surface 320*a* with respect to the recording material feeding direction. Further, the flat surface 320*a* forms a nip surface in the nip N, i.e., a surface substantially parallel to the recording material feeding direction. Each of the curved surfaces 320*b* and 320*c* is a curved surface curved in a direction (upward of FIG. 3) in which the curved surface moves from the nip toward an associated end.

On the other hand, a surface of the fixing pad 320 on a side opposite from the nip N, i.e., a surface opposing the stay 360 is an opposing surface 321 which is a flat surface substantially parallel to the flat surface 320*a*. Further, this opposing surface 321 is a surface-to-be-supported by the stay 360 as described later specifically.

Further, as shown in part (a) of FIG. 4, at a portion which is each of opposite end portions of the flat surface 320*a* of the fixing pad 320 with respect to the longitudinal direction and which is a central portion with respect to a widthwise direction along the rotational direction of the fixing belt 310, a recessed portion 322 cut away from an edge (end) of the fixing pad 320 is formed. Further, as shown in part (b) of FIG. 4, in the recessed portion 322 on one side with respect to the longitudinal direction, an elongated hole 324 penetrating through the opposing surface 321 is formed. Further, as shown in part (c) of FIG. 4, in the recessed portion 322 on the other side with respect to the longitudinal direction, an engaging hole 323 penetrating through the opposing surface 321 is formed.

The stay 360 is formed in the rectangular shape as described above, and as shown in FIG. 3, includes a pair of flat plate portions 363*a* and 363*b* and side plate portions 364*a* and 364*b* each connecting these flat plate portions 363*a* and 363*b*. Further, a space 365 defined by the flat plate portions 363*a* and 363*b* and the side plate portions 364*a* and 364*b* constitutes a hollow-shaped member extending in the longitudinal direction.

Further, the stay 360 includes projected portions 361 each projecting toward the fixing pad 320 at a bottom 362 opposing the fixing pad 320.

The projected portions 361 are formed in a plurality of positions, i.e., two positions in this embodiment, with respect to the widthwise (short-side) direction, and each of the projected portions 361 extends over an entire region with respect to the longitudinal direction. Specifically, each of the projected portions 361 is formed along the longitudinal direction at an associated end portion of the bottom 362 of the stay 360 with respect to the widthwise direction. A length of each of the projected portions 361 with respect to the longitudinal direction is longer than a recording material with a maximum width, which is capable of passing through the nip. That is, opposite ends of the projected portions 361 with respect to the longitudinal direction are positioned outside a region of the recording material with the maximum width, which is capable of passing through the nip.

Such projected portions 361 are formed, in the case where the stay 360 is formed of the drawing material as described above, so as to project from the widthwise ends of the flat plate portion 363*a* when drawing (process) is carried out. Incidentally, the projected portion 361 may also be formed by machining (cutting). Further, in the case where the stay 360 is formed by combining a plurality of metal plates, for example, the flat plate portion 363*a* which is a single metal plate is fixed inside end portions of the pair of side plate portions 364*a* and 364*b*. Then, each of the end portions of the side plate portions 364*a* and 364*b* is projected from the flat plate portion 363*a*, so that the projected portion 361 is formed. In this case, the flat plate portion 363*a* and the side plate portions 364*a* and 364*b* may also be formed by bending a single metal plate.

Further, on each of longitudinal opposite ends of the fixing pad 320-side flat plate portion 363*a* of the stay 360, at the widthwise central portions, a screw hole 366 is formed. A pair of screw holes 366 is formed in positions conforming to the elongated hole 324 and the engaging hole 323, respectively when the fixing pad 320 is assembled with the stay 360.

The stepped screw 391 includes, as shown in FIG. 3 and parts (a) and (b) of FIG. 4, a head (portion) 392, an engaging portion 393 which is circular in cross-section, and a screw portion 394. Such a stepped screw 391 is engaged with each of the elongated hole 324 and the engaging hole 323 of the fixing pad 320, and is screwed and fastened to the screw hole 366 of the stay 360. At this time, the engaging portion 393 of the stepped screw 391 is inserted into each of the elongated hole 324 and the engaging hole 323, and then the screw portion 394 is fastened to the screw hole 366. The head 392 contacts a periphery of each of the elongated hole 324 and the engaging hole 323 of the associated recessed portion 322 of the fixing pad 320.

Specifically, the opposing surface 321 of the fixing pad 320 is contacted to the projected portions 361 of the stay 360. In this state, as described above, the stepped screws 391 are inserted into the elongated hole 324 and the engaging hole 323, respectively, and are fastened to the screw holes 366, respectively. By this, the fixing pad 320 is fixed to the stay 360 with the stepped screws 391 in a state in which the opposing surface 321 contacts the free end surface of the projected portions 361. As a result, positioning of the fixing pad 320 relative to the stay 360 with respect to a height direction (Z-direction of FIG. 3 and part (a) of FIG. 4) is carried out. This height direction is also a direction in which the fixing pad 320 is pressed by the pressing roller 330 through the fixing belt 310.

On the other hand, positioning of the fixing pad 320 with respect to each of the widthwise direction (X-direction of FIG. 3 and part (a) of FIG. 4) and the longitudinal direction (Y-direction of FIG. 3 and part (a) of FIG. 4) is carried out in the following manner. First, the positioning with respect to the X-direction is carried out by engaging the engaging portion 393 of the stepped screw 391 with the elongated hole 324 and the engaging hole 323. The elongated hole 324 is long in the Y-direction. For this reason, the engaging portion 393 of the stepped screw 391 is movable in the Y-direction relative to the elongated hole 324. On the other hand, the engaging hole 323 is a hole with which the engaging portion 393 of the stepped screw 391 is engaged in a state in which movement of the engaging portion 393 is restricted with respect to both the X-direction and the Y-direction. For this reason, the positioning of the fixing pad 320 with respect to the Y-direction is carried out by engaging the engaging portion 393 of the stepped screw 391 with the engaging hole 323.

In this embodiment, the fixing pad 320 is supported by the stay 360 as described above, so that the gap G is formed between the opposing surface 321 of the fixing pad 320 and the bottom 362 of the stay 360 as shown in FIG. 3. That is, the bottom 362 of the stay 360 is provided with the projected portions 361 projecting toward the fixing pad 320 as described above. Further, the projected portions 361 are brought into contact with the fixing pad 320, so that the gap G is formed in at least a part between the bottom 362 and the opposing surface 321 of the fixing pad 320. Specifically, the gap G is formed between the pair of projected portions 361 with respect to the widthwise direction so as to extend over an entire region in the longitudinal direction.

Here, as described above, the fixing pad 320 is made of the resin material and the stay 360 is made of the metal. For this reason, when the fixing pad 320 is supported by the stay 360 heat is liable to be transferred from the fixing belt 310 to the stay 360 through the fixing pad 320. Particularly, as in this embodiment, in the case where the stay 360 is formed in the substantially rectangular shape in cross-section in order to ensure rigidity, it would be considered that the fixing pad 320 is supported by the stay 360 by bringing entirety of the bottom 362 of the stay 360 into contact with the fixing pad 320. However, in this case, an amount of heat moved from the fixing belt 310 to the stay 360 made of the metal through the fixing pad 320 becomes large, so that a turning-on time of the halogen heater 340*a* becomes long for heating the fixing belt 310 to a predetermined temperature. As a result, electric power consumption becomes large.

On the other hand, in the case of this embodiment, as described above, the gap G is formed between the bottom 362 of the stay 360 and the opposing surface 321 of the fixing pad 320. For this reason, between the stay 360 and the fixing pad 320, an air layer corresponding to a gap G portion is interposed, so that the heat does not readily transfer from the fixing pad 320 to the stay 360. As a result, it is possible to suppress the amount of the heat transferring from the fixing pad 320 to the stay 360.

On the other hand, the stay 360 is made of the metal, and therefore, even when a contact surface with the fixing pad 320 is small, rigidity for supporting the fixing pad 320 is easily ensured. For this reason, as described above, the fixing pad 320 can be sufficiently supported by the projected portions 361.

As described above, in order to suppress the amount of the heat transferring from the fixing pad 320 to the stay 361, it is preferable that a dimension (height) of the gap G with respect to the Z-direction is 0.2 mm or more, preferably 0.5 mm or more. In this embodiment, a height of the gap G is 1.0 mm. That is, a heat insulating effect by the air layer becomes higher with an increasing height of the gap G, so that the amount of heat transferring from the fixing pad 320 to the stay 360 can be suppressed.

However, there is a liability that the size of the fixing device becomes larger with the increasing height of the gap G. Further, in order to ensure supporting rigidity by the projected portions 361, an area (area A described later) in which the fixing pad 320 is supported by the projected portions 361 becomes large. When this area becomes large, the amount of the heat transferring from the fixing pad 320 to the stay 360 becomes large. For this reason, the height of the gap G may preferably be 5.0 mm or less, more preferably be 3.0 mm or less, further preferably be 2.0 mm or less.

Further, in the case where the bottom 362 of the stay 360 is seen in the Z-direction, an area of the free end surfaces (supporting surfaces) of the projected portions 361 contacting the opposing surface 321 of the fixing pad 320 is A, and an area of the surface-to-be-supported 362*a* which does not contact the opposing surface 321 is B. In this case, an areal ratio of the area A to an entire area of the bottom 362 (i.e., (A/(A+B)×100%) may preferably be 5% or more and 40% or less. It is preferable that this areal ratio is 10% or more and is further preferably 30% or less. In summary, depending on a material or the like of the stay 360, the area A may preferably be ensured so that rigidity such that the projected portions 361 can sufficiently support the fixing pad 320 against a pressing force by the pressing roller 330. Further, a smaller areal ratio is preferred since a contact area between the fixing pad 320 and the stay 360 is made smaller and thus the amount of the heat transferring from the fixing pad 320 to the stay 360 can be suppressed.

Embodiment

Here, an experiment conducted for confirming an effect of this embodiment will be described using parts (a) to (d) of FIG. 5 and FIG. 6. In this experiment, the fixing device 8 as shown in FIG. 2 was used. Further, electric power of 3000 W was inputted to the halogen heater 340*a* in the heating roller 340, and then the temperature of the stay 360 in a steady state when temperature control of the fixing belt 310 is carried out at 190° C. was measured. Further, in this experiment, as shown in parts (a) to (d) of FIG. 5, the gap G between the fixing pad 320 and the stay 360 is changed, and a temperature of the stay 360 in a measuring point H at each of the changed heights. The measuring point H was a substantially central portion of the flat surface portion 363*b* with respect to the widthwise (short-side) direction on a side of the stay 360 opposite from the fixing pad 320.

A constitution shown in part (a) of FIG. 5 is a comparison example in which the gap G between the fixing pad 320 and the stay 360 is 0 mm, i.e., there is no gap G. On the other hand, in a constitution shown in part (b) of FIG. 5, the gap G is 0.2 mm, in a constitution shown in part (c) of FIG. 5, the gap G is 0.5 mm, and in a constitution shown in part (d) of FIG. 5, the gap G is 1.0 mm, so that these three constitutions satisfy a requirement of this embodiment.

FIG. 6 shows the temperature of the stay 360 at a measuring point H in the case where the fixing belt 310 is controlled at 190° C. in each of the constitutions shown in parts (a) to (d) of FIG. 5 as described above. Parts (a) to (d) of FIG. 6 correspond to parts (a) to (d) of FIG. 5, respectively.

As apparent from FIG. 6, in part (a) which is the comparison example there is no gap G (G=0 mm), and therefore, due to transfer of the heat from the fixing pad 320, the temperature of the stay 360 at the measuring point H was increased up to 160° C. On the other hand, in part (b) which is this embodiment, the gap of 0.2 mm is provided, and therefore, the heat transfer is blocked by the heat insulating effect by the gap G, so that the temperature of the stay 360 at the measuring point H was lowered to about 155° C.

Further, in part (c) which is this embodiment, the gap of 0.5 mm is provided, and therefore, the heat transfer is further blocked by the heat insulating effect by the gap G, so that the temperature of the stay 360 at the measuring point H was lowered to about 150° C. Further, in part (d) which is this embodiment, the gap G of 1.0 mm is provided, and therefore, by the heat insulating effect by the gap G, the temperature of the stay 360 at the measuring point H was about 148° C.

From the above-described result, by providing the gap G between the stay 360 and the fixing pad 320, it was confirmed that the amount of heat transferring to the stay is decreased by the heat insulating effect by the gap G. Further, in the constitution of this embodiment, the areal ratio of the area A of the free end surfaces 361*a* of the projected portions 361 and the area B of the surface-to-be-supported 362*a* of the bottom 362 is 20%:80%, so that by providing the gap G of 0.5 mm or more, it was confirmed that the heat insulating effect by the gap G can be sufficiently exhibited.

Second Embodiment

A second embodiment will be described using FIG. 7. In the above-described first embodiment, the projected portions for forming the gap G were provided on the stay 360 side. On the other hand, in this embodiment, the projected portions for forming the gap G are provided on a fixing pad 320A side. Other constitutions and actions are similar to those in the first embodiment and therefore, similar constitutions are represented by the same reference numerals or symbols and are omitted from description and illustration or briefly described. In the following a difference from the first embodiment will be principally described. Incidentally, as regards constituent elements common to the first and second embodiments, reference numerals or symbols will be partially omitted.

A fixing pad unit 390A constituting a fixing device of this embodiment is constituted similarly as in the first embodiment by fixing a fixing pad 320A and the stay 360A with stepped screws 391. The stay 360A is formed of metal in a substantially rectangular shape in cross-section similarly as in the first embodiment and is similar to the stay 360 in the first embodiment except that the projected portion 361 is not provided. Further, the fixing pad 320A is formed of a resin material similarly as in the first embodiment and is similar to the fixing pad 320 in the first embodiment except that projected portions 321*a* are provided.

That is, the bottom 362 of the stay 360A opposing the fixing pad 320A is a flat surface. On the other hand, the opposing surface 321 of the fixing pad 320A opposing the stay 360A is provided with the projected portions 321*a* projecting toward the stay 360A. The projected portions 321*a* are formed in a plurality of positions, i.e., two positions in this embodiment, with respect to the widthwise direction so as to extend over an entire region in the longitudinal direction. Specifically, the projected portions 321*a* are formed along the longitudinal direction at end portions of the opposing surface 321 of the fixing pad 320A with respect to the widthwise direction. The projected portions 321*a* are integrally molded with the fixing pad 320A. A length of each of the projected portions 321*a* in this embodiment is longer than a length of a recording material with a maximum width, which is capable of passing through the nip. That is, longitudinal ends of each of the projected portions 321*a* are positioned outside a sheet passing region of the recording material with the maximum width, which is capable of passing through the nip.

In the case of the above-described this embodiment, the projected portions 321*a* of the fixing pad 320A are contacted to the bottom 362 of the stay 360A, and the fixing pad 320A is fixed to the stay 360A by the stepped screw 391 similarly as in the first embodiment. Thus, the gap G is formed between the opposing surface 321 of the fixing pad 320A and the bottom 362 of the stay 360A. That is, by bringing the projected portions 321*a* of the fixing pad 320A into contact with the stay 360A, the gap G is formed in at least a part between the bottom 362 of the stay 360A and the opposing surface 321 of the fixing pad 320A. Specifically, the gap G is formed between the pair of projected portions 321*a* with respect to the widthwise direction so as to extend over an entire region in the longitudinal direction.

Further, also, in the case of this embodiment, a dimension (height) of the gap G with respect to the Z-direction may preferably be 0.2 mm or more, more preferably be 0.5 mm or more. Further, the height of the gap G may preferably be 5.0 mm or less, more preferably be 3.0 mm or less, further preferably be 2.0 mm or less.

Further, in the case where the bottom 362 of the stay 360A is seen in the Z-direction, an area of supporting surfaces 361*b* contacting free end surfaces (surface-to-be-supported) of the projected portions 321*a* of the fixing pad 320A is A, and an area of the surface-to-be-supported 362*a* which does not contact the projected portions 321*a* is B. In this case, similarly as in the first embodiment, an areal ratio ((A/(A+B))×100%) of the area A to an entire area of the bottom 362 may preferably be 5% or more and 40% or less. Further, this areal ratio may preferably be 10% or more and may further preferably be 30% or less.

In this embodiment, the constitution in which the projected portions 321*a* are provided at opposite end portions of the fixing pad 320A with respect to the widthwise direction was employed, but a constitution in which in addition to this, a similar projected portion is provided at a central portion with respect to the widthwise direction may also be employed.

Third Embodiment

A second embodiment will be described using FIGS. 8 and 9. In the above-described first embodiment, the two projected portions for forming the gap G were provided. On the other hand, in this embodiment, the number of the projected portions are further increased. Other constitutions and actions are similar to those in the first embodiment and therefore, similar constitutions are represented by the same reference numerals or symbols and are omitted from description and illustration or briefly described. In the following a difference from the first embodiment will be principally described. Incidentally, as regards constituent elements common to the first and second embodiments, reference numerals or symbols will be partially omitted.

A fixing pad unit 390B constituting a fixing device of this embodiment is constituted similarly as in the first embodiment by fixing a fixing pad 320A and the stay 360A with stepped screws 391. The stay 360A is formed of metal in a substantially rectangular shape in cross-section similarly as in the first embodiment and is similar to the stay 360 in the first embodiment except that the number of the projected portions 361 is large. Further, the fixing pad 320 has the same constitution as the fixing pad 320 in the first embodiment.

As regards a stay 360B in this embodiment, the bottom 362 of the stay 360B opposing the fixing pad 320 is provided with projected portions 361 projecting toward the fixing pad 320. The projected portions 361 are formed in a plurality of positions, i.e., four positions in this embodiment, with respect to the widthwise direction so as to extend over an entire region in the longitudinal direction. Specifically, in addition to two projected portions 361 provided at the opposite end portions of the bottom 362 of the stay 360B with respect to the widthwise direction, and other two projected portions 361 are formed along the longitudinal direction at portions close to a central portion with respect to the widthwise direction. These projected portions 361 are provided with intervals from each other with respect to the widthwise direction.

Also, in this embodiment, the fixing pad 320 is supported by the stay 360B, so that as shown in FIG. 8, gaps G are formed between the opposing surface 321 of the fixing pad 320 and the stay 360B. Each of the gaps G is formed between the adjacent projected portions 361 with respect to the widthwise direction so as to extend over an entire region in the longitudinal direction.

Further, also, in the case of this embodiment, a dimension (height) of each of the gaps G with respect to the Z-direction may preferably be 0.2 mm or more, more preferably be 0.5 mm or more. Further, the height of each of the gaps G may preferably be 5.0 mm or less, more preferably be 3.0 mm or less, further preferably be 2.0 mm or less.

Further, in the case where the bottom 362 of the stay 360B is seen in the Z-direction, an area of free end surfaces (supporting surface) 361*a* of the projected portions 361 is A, and an area of the surface-to-be-supported 362*a* is B. Also, in this case, an areal ratio ((A/(A+B))×100%) may preferably be 5% or more and 40% or less. Further, this areal ratio may preferably be 10% or more and may further preferably be 30% or less.

In this embodiment, a constitution in which the heat insulating effect by the gap G can be achieved by making the areal ratio, of the area of the free end surfaces (supporting surfaces) 361*a* of the projected portions 361 and the area B of the surface-to-be-supported 362*a*, 40%:60% and by providing the gap G of 0.5 mm or more was employed.

In such a case of this embodiment, the number of the projected portions 361 is made larger than that in the constitution of the first embodiment, so that the area in which the fixing pad 320 is supported is increased. For this reason, compared with the constitution as in the first embodiment in which the fixing pad 320 is supported by the projected portions 361 provided at the opposite end portions, flexure of the fixing pad 320 with respect to the recording material feeding direction (X-direction) can be suppressed.

Fourth Embodiment

A fourth embodiment will be described using parts (a) and (b) of FIG. 10. In the above-described first embodiment, the gap G was formed over the entire region with respect to the longitudinal direction of the stay 360. On the other hand, in this embodiment, the gap G is formed at opposite end portions with respect to the longitudinal direction. Other constitutions and actions are similar to those in the first embodiment and therefore, similar constitutions are represented by the same reference numerals or symbols and are omitted from description and illustration or briefly described. In the following a difference from the first embodiment will be principally described. Incidentally, as regards constituent elements common to the first and second embodiments, reference numerals or symbols will be partially omitted.

Part (a) of FIG. 10 is an exploded perspective view of a fixing pad unit 390C including the fixing belt 310. In part (a) of FIG. 10, the fixing pad unit 390C is shown by seeing through the fixing belt 310. A fixing pad unit 390C constituting a fixing device of this embodiment is constituted similarly as in the first embodiment by fixing the fixing pad 320 and the stay 360C with stepped screws 391. The stay 360C is formed of metal in a substantially rectangular shape in cross-section similarly as in the first embodiment and is similar to the stay 360 in the first embodiment except that projected portions 361*c* are formed at longitudinal end portions of the stay 360C. Further, the fixing pad 320 has the same constitutions as the first embodiment.

In the case of this embodiment, the projected portions 361*c* of the stay 360C are provided so as to form gaps G at opposite end portions of the fixing pad 320 with respect to the longitudinal direction. Specifically, a bottom 362A of the stay 360C opposing the fixing pad 320 constitutes a contact portion 362*c* contacting the opposing surface 321 of the fixing pad 320 at a central portion with respect to the longitudinal direction. Each of the projected portions 361*c* is provided along the longitudinal direction from the central contact portion 362*a* to an associated end of the stay 360C with respect to the longitudinal direction. Further, at each of the longitudinal end portions, a pair of projected portions 361*c* is provided at widthwise end portions of the stay 360C. Accordingly, in the case of this embodiment, the stay 360C supports the longitudinal central portion of the fixing pad 320 by the contact portion 362*c* thereof and supports the longitudinal end portions by the projected portions 361*c*.

Here, the fixing belt 310 is formed in a thin layer, and therefore, thermal capacity is very small, and a degree of a lowering in temperature due to heat dissipation becomes large. Therefore, an end portion temperature decrease (temperature difference between the end portion and the central portion) is liable to occur. For example, when heating of the fixing belt 310 is started during power-on of the image forming apparatus, the fixing belt 310 is liable to dissipate heat at the longitudinal end portions than at the longitudinal central portion. As a result, the fixing belt 310 is liable to cause the end portion temperature decrease such that the longitudinal end portion temperature of the fixing belt 310 lows compared with the longitudinal central portion temperature of the fixing belt 310.

In the case of this embodiment, as described above, by forming the gaps G at the longitudinal end portions of the fixing pad 320, at opposite end portions of the fixing belt 310, an amount of heat transferring from the fixing belt 310 to the stay 360C through the fixing pad 320 can be suppressed. That is, heat dissipation to the stay 360C can be suppressed at the opposite end portions of the fixing belt 310. For this reason, it is possible to suppress the occurrence of the above-described end portion temperature decrease.

Further, also, in the case of this embodiment, a dimension (height) of the gap G with respect to the Z-direction may preferably be 0.2 mm or more, more preferably be 0.5 mm or more. Further, the height of the gap G may preferably be 5.0 mm or less, more preferably be 3.0 mm or less, further preferably be 2.0 mm or less.

Further, in this embodiment, the areal ratio described in the first embodiment is based on a region a (part (b) of FIG. 10) where the projected portions 361*c* are formed in the case where the bottom 362A of the stay 360C is seen in the Z-direction. That is, an area of free end surfaces (supporting surfaces) 361*d* of the projected portions 361*c* of the stay 360C, except for the contacting portion 362*c*, contacting the opposing surface 321 of the fixing pad 320A is A, and an area of the surface-to-be-supported 362*b* which does not contact the opposing surface 321 is B. In this case, an areal ratio ((A/(A+B))×100%) of the area A of the region a to an entire area of the bottom 362 may preferably be 5% or more and 40% or less. Further, this areal ratio may preferably be 10% or more and may further preferably be 30% or less.

In this embodiment, the areal ratio of the area A of the free end surfaces (supporting surfaces) 361*d* of the projected portions 361*c* and the area B of the surface-to-be-supported 362*b* is 20%:80%, and the gap of 0.5 mm or more is provided, so that a constitution in which the heat insulating effect by the gap G can be achieved is employed.

Other Embodiments

In the above-described embodiments, the constitution in which the heating roller is provided with the halogen heater as the heating source for heating the fixing belt was described. However, the heating source may also be provided in the stretching member such as the steering roller without being provided in the heating roller. Further, the heating source may also be provided in the pad member. For example, a plate-like heating member such as a ceramic heater may also be provided on the fixing belt side of the pad member. Further, a constitution in which the fixing belt is heated through electromagnetic induction heating may also be employed.

Further, in the above-described embodiments, the fixing device in which the fixing belt is stretched by the fixing pad, the heating roller and the steering roller was described. However, the fixing device to which the present invention is applicable is not limited thereto, but for example, a constitution in which the fixing belt is stretched by only a single stretching roller and the fixing pad may also be employed. In summary, it is only required that at least one stretching roller for stretching the fixing belt is provided together with the fixing pad.

Further, the projected portions, for forming the gap G, provided on the fixing pad as described in the second embodiment may also be provided at three or more positions as in the third embodiment and may also be provided at the longitudinal end portions of the fixing pad as in the fourth embodiment.

Further, as regards the projected portions provided on the stay or the fixing pad in the above-described embodiments, shapes and the number thereof can be appropriately set when the gap(s) can be formed between the stay and the fixing pad and when the fixing pad can be supported by the stay. For example, a plurality of projected portions each formed in a circular shape, an elliptical shape, or a polygonal shape such as a triangular shape as seen in the Z-direction may also be provided on the stay or the fixing pad.

Further, in the above-described embodiments, the constitution in which the pressing roller is used as the rotatable driving member was described. However, the rotatable driving member may also be an endless belt which is stretched by a plurality of stretching rollers and which is driven by either one of the stretching rollers. Further, in the above-described embodiments, in order to form the nip, the pressing roller as the rotatable driving member is pressed against the belt, but a constitution in which the belt is pressed against the rotatable driving member may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-228643 filed on Dec. 18, 2019, which is hereby incorporated by reference herein in its entirety.

What is claimed is:

1. A fixing device for fixing a toner image on a recording material, said fixing device comprising:

a rotatable fixing belt;

a heating roller including a heater, wherein said belt is stretched around said heating roller to heat said belt;

a pressing pad of resin material provided inside of said belt;

a rotatable pressing member contacting an outer peripheral surface of said belt and pressing against said pressing pad through said belt to form a nip configured to nip and feed the recording material;

a supporting metal stay supporting said pressing pad and including a planar bottom surface faced to said pressing pad; and a plurality of projected portions integrally molded with said pressing pad and provided along a widthwise direction of said pressing pad, said projected portions projecting and contacting to the bottom surface such that said pressing pad is supported by said supporting stay, wherein a contact area between said projected portions and said bottom surface is not less than 5% and not more than 40% of the area of said bottom surface, and wherein a gap is provided between said bottom surface and said pressing pad, and the gap is not less than 0.5 mm and not more than 5.0 mm.

2. The fixing device according to claim 1, wherein said projected portions extend in a longitudinal direction of said pressing pad.

3. The fixing device according to claim 1, wherein said supporting stay has a hollow rectangular parallelepiped shape.

4. The fixing device according to claim 1, wherein said supporting stay has a substantially rectangular cross-section in a plane perpendicular to a longitudinal direction of said supporting stay extending in a direction crossing with a rotational movement direction of said belt.

5. The fixing device according to claim 1, wherein said pressing member includes a driving roller configured to apply a driving force to said belt.

6. The fixing device according to claim 1, further comprising a stretching roller around which said belt is stretched, wherein said belt is supported by said pressing pad and said stretching roller.

7. A fixing device for fixing a toner image on a recording material, said fixing device comprising:

a rotatable fixing belt;

a heating roller including a heater, wherein said belt is stretched around said heating roller to heat said belt;

a pressing pad of resin material provided inside of said belt;

a rotatable pressing member contacting an outer peripheral surface of said belt and pressing against said pressing pad through said belt to form a nip configured to nip and feed the recording material;

a supporting metal stay supporting said pressing pad and including a planar bottom surface faced to said pressing pad; and a plurality of projected portions integrally molded with said pressing pad and provided along a widthwise direction of said pressing pad, said projected portions projecting and contacting to the bottom surface such that said pressing pad is supported by said supporting stay, wherein a contact area between said projected portions and said bottom surface is not less than 5% and not more than 40% of the area of said bottom surface, and wherein a length of said projected portions measured in a longitudinal direction thereof is larger than a width of the recording material having a maximum size that is capable of being processed by said fixing device.

8. A fixing device for fixing a toner image on a recording material, said fixing device comprising:

a rotatable fixing belt a heating roller including a heater, wherein said belt is stretched around said heating roller to heat said belt a pressing pad of resin material provided inside of said belt a rotatable pressing member contacting an outer peripheral surface of said belt and pressing against said pressing pad through said belt to form a nip configured to nip and feed the recording material;

a supporting metal stay supporting said pressing pad and including a planar bottom surface faced to said pressing pad; and a plurality of projected portions integrally molded with said pressing pad and provided along a widthwise direction of said pressing pad, said projected portions projecting and contacting to the bottom surface such that said pressing pad is supported by said supporting stay, wherein a contact area between said projections and said bottom surface is not less than 5% and not more than 40% of the area of said bottom surface, and wherein said pressing pad is supported by said supporting stay with a fixing element in an area outside a recording material passing area.

* * * * *